US008991816B1

(12) United States Patent
Sundararaj et al.

(10) Patent No.: US 8,991,816 B1
(45) Date of Patent: Mar. 31, 2015

(54) MECHANISM TO DETECT LINEAR MOTION USING CAM PATH

(71) Applicant: Xerox Corporation, Norwalk, CT (US)

(72) Inventors: Vasu Sundararaj, Tamil Nadu (IN); Karthik Jayaraj, Pudhucherry (IN); Saravanan Ragavendran, Tamil Nadu (IN)

(73) Assignee: Xerox Corporation, Norwalk, CT (US)

( * ) Notice: Subject to any disclaimer, the term of this patent is extended or adjusted under 35 U.S.C. 154(b) by 70 days.

(21) Appl. No.: 14/044,910

(22) Filed: Oct. 3, 2013

(51) Int. Cl.
*B65H 1/04* (2006.01)

(52) U.S. Cl.
CPC ..... *B65H 1/04* (2013.01); *B65H 2301/4222* (2013.01); *B65H 2405/1142* (2013.01); *B65H 2553/61* (2013.01)
USPC ..... 271/171

(58) Field of Classification Search
CPC ..... B65H 31/20; B65H 2301/4222; B65H 2403/512; B65H 2403/514; B65H 2405/114; B65H 2405/1142; B65H 2405/11425; B65H 2405/1144; B65H 2553/61; B65H 2553/612; B65H 2553/81
USPC ..... 271/171
See application file for complete search history.

(56) References Cited

U.S. PATENT DOCUMENTS

| | | | | |
|---|---|---|---|---|
| 7,413,188 | B2 * | 8/2008 | Miki | 271/171 |
| 7,635,129 | B2 * | 12/2009 | Inoue | 271/258.01 |
| 7,694,960 | B2 * | 4/2010 | Sing | 271/171 |
| 7,992,862 | B2 * | 8/2011 | Kuo | 271/171 |
| 8,061,708 | B2 * | 11/2011 | Fujita et al. | 271/171 |
| 8,387,972 | B1 * | 3/2013 | Ledgerwood et al. | 271/171 |
| 8,584,371 | B2 * | 11/2013 | Marumoto et al. | 33/555 |

FOREIGN PATENT DOCUMENTS

| | | | | |
|---|---|---|---|---|
| JP | 63185730 A | * | 8/1988 | B65H 1/26 |
| JP | 63196458 A | * | 8/1988 | B65H 31/20 |

* cited by examiner

*Primary Examiner* — Jeremy R Severson

(57) ABSTRACT

In a mechanism for detecting the size of media loaded in a media tray of an imaging device, the media tray includes at least one pair of media guiding members for alignment with the edges of the media. The media size sensing mechanism includes two racks operatively connected to the pair of media guiding members, a pinion positioned between the two racks, a cam structure attached to the pinion, and a sensor depicting the corresponding size of the loaded media. The cam structure defines an arcuate surface engaging a sliding pin of the sensor. The arcuate surface of the cam structure is configured to slide the pin linearly between a first extreme linear position and a second extreme linear position, as the cam rotates between a first extreme angular position and a second extreme angular position.

10 Claims, 4 Drawing Sheets

MECHANISM TO DETECT LINEAR MOTION USING CAM PATH

TECHNICAL FIELD

Embodiments of the present disclosure generally relate to imaging devices, and, more specifically, to mechanisms for detecting the size of media loaded in trays of imaging devices.

BACKGROUND

Media loading trays in imaging devices, such as printers and photocopiers, generally have the capacity to load and accommodate media of different sizes. The media loading trays within such devices are well equipped to automatically detect the size of media loaded into the tray. Automatic detection of media size helps prevent certain types of errors, such as, printing on the wrong size, or at a wrong location over the loaded media. To detect the size of the media loaded in the loading tray, one or more movable guides are incorporated within such trays, and a user slides the movable guides to align with the edges of the loaded media.

Conventionally, in many imaging devices, the movable guides are attached to a rack and pinion mechanism. Specifically, the rack is operatively connected to the guide, and transmits the linear motion in response to the movement of the guide. In response to rack's movement, the pinion rotates either clockwise or counter-clockwise, depending on the sense of movement of the guides. A mechanism is connected to the pinion, which detects the degree of rotation of the pinion. The mechanism has a sensor array which generates a signal corresponding to the degrees of rotation of the pinion. Further, the sensor is configured to send a signal to a processing unit. The processing unit converts that signal into a value representing the distance traversed by the movable guides, which facilitates detection of the size of the media loaded into the media loading tray. Eventually, the detected media size is displayed on a user interface of the imaging device.

Among the other conventional approaches, some imaging devices detect the media size automatically, by using two linear sensors, generally. Such linear sensors typically have pins capable of sliding within them, along their lengths. One of the sensors is associated with a movable guide positioned along the length of the loaded media, and the other is associated with a guide positioned along the width of the media. These sensors, being coupled to a rack, are capable of measuring the dimensions (i.e., length and width) of media, using the distance traversed by the guides. Specifically, the rack is directly attached to the guides, and connected to a pinion, to affect rotary motion of the pinion in response to linear movement of the racks, when the guides are moved to align along the edges of the loaded media. The pins within the sensors, being connected to the pinion, slide therein, in response to pinion's rotation. However, the linear sensors incorporated in such conventional mechanism, can measure distances only up to 30 to 40 mm. Alternatively, a linkage mechanism may be positioned between the rack and the sensors, to generate signals corresponding to the media size. The linkage mechanism may be a spring, for example. As the user adjusts the guides to align with the media, the rack move linearly. The rack pushes the link mechanism, which causes the pin to side within the sensor. Eventually, the sensor transmits a signal based on the extent of movement of the pin. The signal is processed by a processing unit, which generates a value representing the size of the loaded media.

However, such conventional systems are costly, need collaboration of many components, and can reduce reliability.

Additionally, some automatic media sensing systems may have difficulty distinguishing between loaded media having different dimensions.

Therefore, considering the problems mentioned above, a need exists for an effective mechanism within an imaging device, which can automatically detect the size of the loaded media, precisely, and be more reliable, compared to conventional imaging devices.

SUMMARY

The present disclosure provides a mechanism for detecting the size of a media loaded within an imaging device. The imaging device can be a printer, scanner, etc. The detected size of the loaded media is displayed on a user interface of the imaging device.

In one aspect of the present disclosure, the mechanism for detecting the size of the media loaded within the imaging device includes two movable guiding members positioned within a media loading tray of the imaging device. The guiding members align with the edges of the media, and are coupled to a pair of racks. The two racks move in opposite directions, in response to the movement of the two guiding members. A pinion is positioned between the two racks, and it rotates in response to the movement of the racks. The pinion rotates either clockwise or counterclockwise depending on the sense of movement of the racks. A cam is fixedly attached to, and lies coaxially with the pinion, in a manner that it substantially surrounds the outer portion of the pinion. The cam rotates along with the rotation of the pinion, and has an arcuate slot provided along its outer portion. The mechanism also includes a sensor coupled to the cam. The sensor includes a sliding pin coupled to the slot within the cam. The pin slides within the sensor, in response to the rotation of the cam. As the pin slides, the sensor transmits a signal corresponding to the size of the loaded media.

DETAILED DESCRIPTION

The following detailed description is made with reference to the figures. Preferred embodiments are described to illustrate the disclosure, and are not to limit its scope, which is defined by the claims. Those of ordinary skill in the art will recognize a variety of equivalent variations of the description that follows.

Imaging devices, such as, printers and scanners, typically include inbuilt media loading trays which are configured to accommodate various standard sizes of paper. Such media loading trays employ different mechanisms for automatically detecting the size of the media loaded into the trays. These mechanisms typically include various components operatively coupled and collaborating with each other, to detect the size of the loaded media, such as, racks, pinion, and sensors, to detect the media size.

The present disclosure provides a mechanism for automatically detecting the size of a media loaded within an imaging device. The mechanism is reliable, user friendly, and provides a cost effective solution that precisely determines the size of the loaded media.

With reference to the present disclosure, the term "media", wherever mentioned hereinafter, may be construed as, and can be applied to substantially blank sheets on which images can be printed or copied by an imaging device, and image bearing sheets loaded for input scanning in imaging devices, for examples, scanners, facsimile machines and copiers.

EXEMPLARY EMBODIMENTS

Figure 1A:
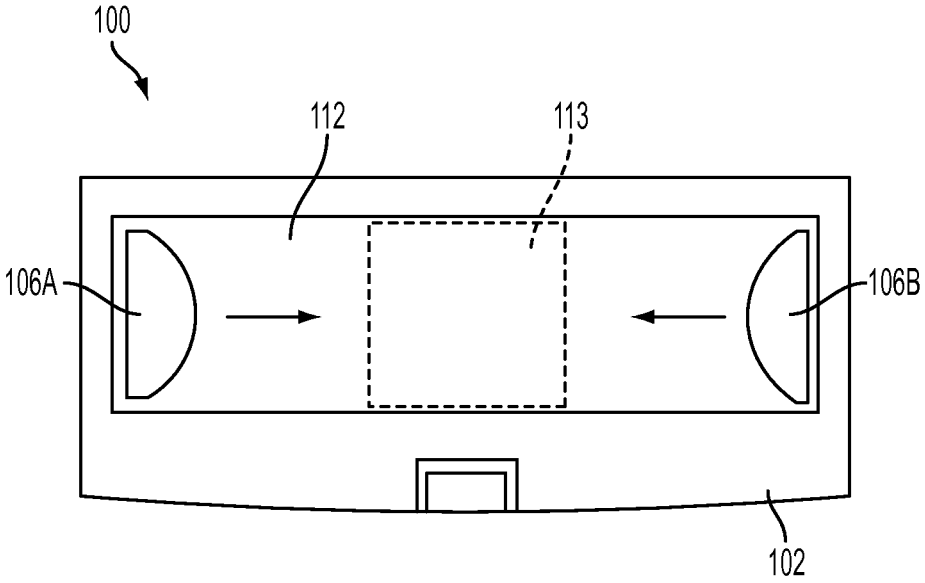
FIG. 1A is a top view of a Multi Sheet Tray Assembly of an imaging device, in accordance with the present disclosure.

FIG. 1A illustrates a top view of a Multi sheet tray assembly 100 of an imaging device of the present disclosure, for loading and incorporating media of different sizes. The imaging device may be a scanner, a photocopier, or a printer, etc.

Generally, there are two types of media loading trays within such imaging devices, based on their orientation within the imaging device. In one type the user loads the media along the 'short edge first direction', i.e., in a manner that the width of media faces towards the imaging device. The others type is 'long edge first direction' type, where the user loads the sheet material with its length facing toward the imaging device. The 'short edge first direction' and the 'long edge first direction' are also referred to as the 'process direction' and the 'cross process direction', respectively.

In an embodiment of the present disclosure, the user inserts the media 113 in the multi sheet tray assembly 100, along the 'process direction', i.e., with the width of the media 113 facing toward the imaging device.

Figure 1B:
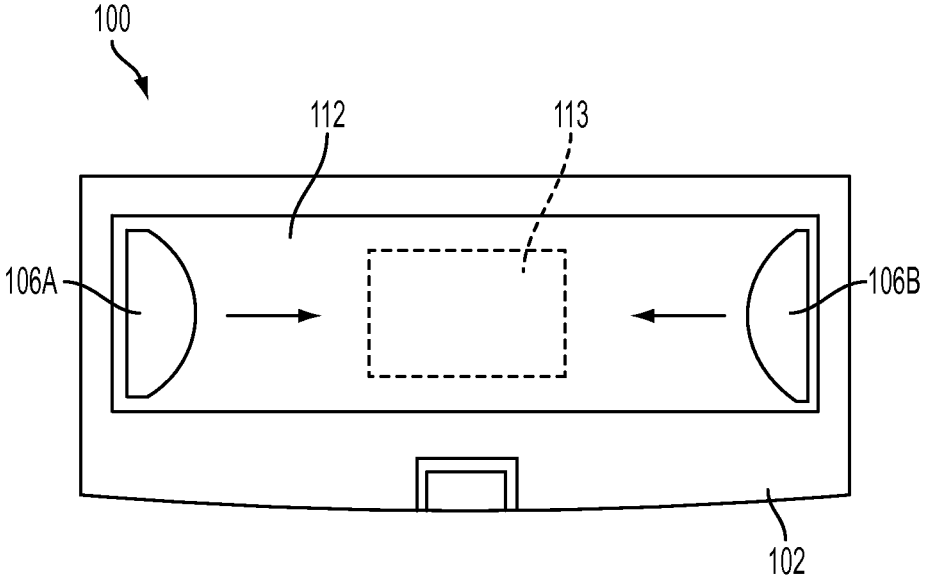
FIG. 1B is a top view of a Multi Sheet Tray Assembly of an imaging device, wherein the user loads the sheet media in the 'cross process direction', in accordance with another embodiment of the present disclosure.

FIG. 1B illustrates a top view of a Multi sheet tray assembly 100, wherein the user loads the sheet media 113 in the Multi sheet tray assembly 100, along the 'cross process direction', i.e., with the length of the sheet media 113 facing towards the imaging device.

The multi sheet tray assembly 100 includes a stacking area 112 that stores media, and supplies the media to the relevant portion of the imaging device, when a user command is received. The stacking area 112 is surrounded by an external structure 102 comprising four walls and a floor, and can accommodate media of various sizes, such as the standard A-series and B-series paper sizes. Further, the stacking area 112 includes two guiding members 106A and 106B. These guiding members are 'width guides', which can be slid along the width of the stacking area 112, by a user. The guiding members 106A and 106B project above the floor of the multi sheet tray assembly 100, and on being slid over the stacking area 112, they eventually align with opposite edges of the loaded media. Depending on the orientation of the loaded media, the guiding members may align with any of the set of opposite edges of the media.

Further, the two guiding members 106A and 106B are operatively connected to each other, in a manner that they simultaneously move either towards, or away from, each other. More specifically, the guiding members 106A and 106B can either be slid inward, towards each other, or slid outwards, away from each other, simultaneously.

Preferably, the size of the multi sheet tray assembly 100 is approximately SRA3 (432×297 mm)|Size, such that the stacking area 112 can accommodate media sizes up to B5 (approx. 176×250 mm). However, loading trays of any other size can also be used, to facilitate accommodation of media of any dimensions. Each of the guiding members 106A and 106B, is configured to traverse distance, either inwards or outwards.

Figure 2A:
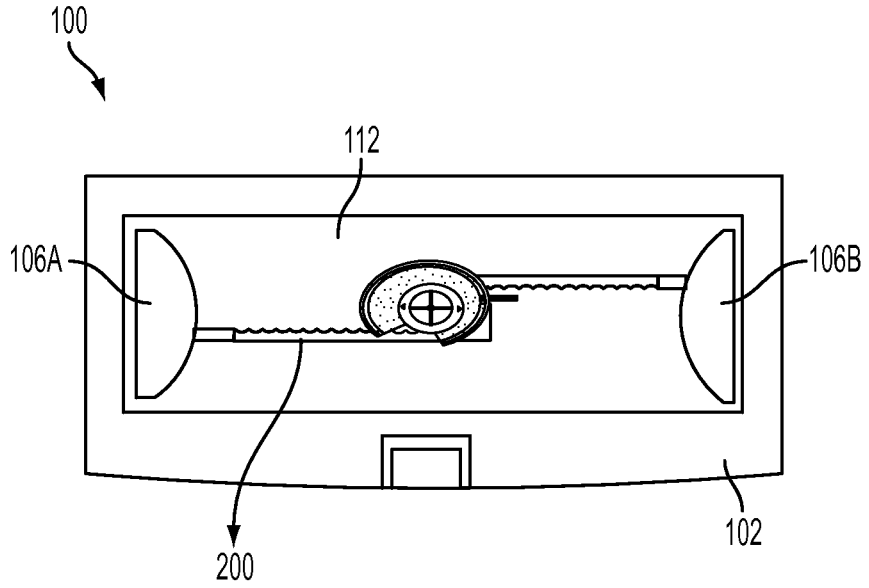
FIG. 2A shows the mechanism for automatically detecting the size of media loaded within an imaging device, in accordance with the present disclosure, the mechanism being positioned underneath the Multi Sheet Tray Assembly of FIG. 1A.

FIG. 2A shows the mechanism 200 for automatically detecting the size of the loaded media, positioned underneath the multi sheet tray assembly 100. The mechanism 200 is configured to transmit signals to a user interface, notifying the user of information related to the size of the media loaded in the multi sheet tray assembly 100. The mechanism 200 is operatively connected to each of the guiding members 106A and 106B. The integral components of the mechanism 200, and their functionality, are described in further detail, hereinafter.

Figure 2B:
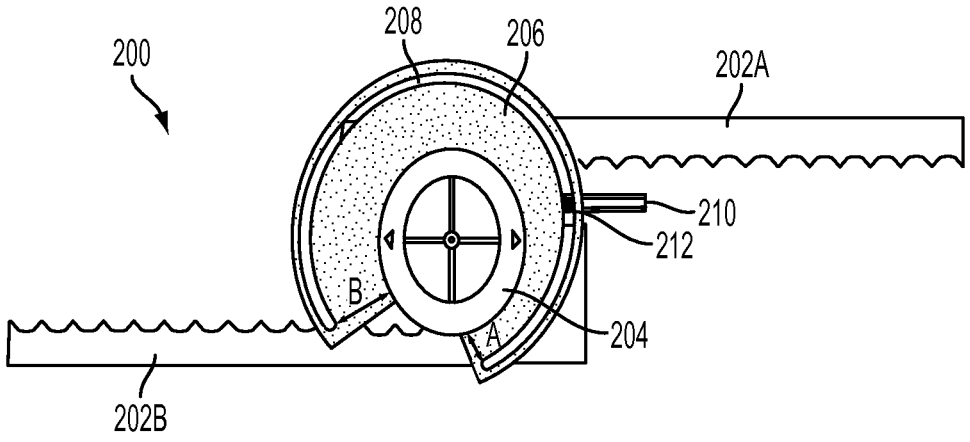
FIG. 2B illustrates the different components of the mechanism for detecting the size of the loaded media, in accordance with the present disclosure.

As shown in FIG. 2B, the mechanism 200 includes a pair of racks 202A and 202B. Each of the racks 202A and 202B is operatively coupled to a pinion 204, constituting a rack and pinion mechanism. The racks are capable of moving linearly, either towards, or away from each other, to facilitate anti-clockwise, or clockwise rotation of the pinion 204, respectively. Further, the racks 202A and 202B are elongate members, and have an L-shaped cross-section each. However, any other appropriate cross-sectional shape can also be used as an alternative, thus, not limiting the scope of the invention to the present disclosure. Each of the racks 202A and 202B has a plurality of teeth/gears along one side, and is positioned in a manner that the geared sides face the geared side of the other rack. The length of the racks 202A and 202B may vary, depending on certain factors, including the size of the multi sheet tray assembly 100.

The guiding members 106A and 106B (shown in FIG. 1B) are operatively connected to, and centrally aligned with the racks 202A and 202B, respectively. Any suitable means can be used to connect the guiding members 106A and 106B to the racks 202A and 202B, to facilitate movement of the racks in response to the movement of the guiding members. Specifically, as the guiding members 106A and 106B are moved inwards, to align with opposite edges of the loaded media 113, the racks 202A and 202B move toward each other. Similarly, when the guiding members 106A and 106B are moved apart to accommodate the media 113, the racks 202A and 202B move away from each other.

Figure 3:
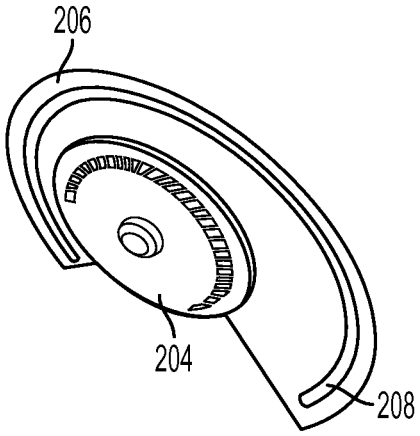
FIG. 3 illustrates a perspective view of a cam and pinion, connected to each other, and being integral components of the mechanism of the present disclosure.

As shown, the pinion 204 is disposed between, and meshes with, the geared edges of the racks 202A and 202B. Multiple teeth/gears are provided along the outer circumference of the pinion 204, as shown in FIG. 3. The geared outer surface of the pinion 204 engages with the geared sides of the racks 202A and 202B, simultaneously.

A cam 206 surrounds the pinion 204. The cam 206 is connected to the pinion, and rotates along with the rotation of the pinion 204. The cam 206 defines a slot with an increasing radial width, the percentage increase in width being constant for every degree of rotation of the cam. The advantages of this will be explained in detail hereinafter. Further, in this embodiment an arcuate cam-slot 208 of uniform width is provided along an outer portion of the cam 206.

A sensor 210 is fixedly mounted relative to the cam 206, in a manner that it remains stationary, when the cam 206 rotates. A pin 212 is positioned within the sensor 210, and is capable of sliding therein, in response to the rotation of the cam 206. Specifically, in this embodiment the pin 212 engages the cam-shaped slot 208 within the cam, and rotation of the cam 206 makes the pin 212 slide towards the right or left, depending on the sense of rotation of the cam. The sensor 210 is a linear potentiometer, which generates a signal based on the distance moved by the pin 212, while sliding within the sensor 210. It will be appreciated that although the term "cam" was used to define the structure 206, only the surface or surfaces engaging the pin 212 (in this embodiment, the slot 208) need to define cam-shaped surfaces to translate the rotational movement of the cam structure to linear movement of the pin 212.

The collaboration of the different illustrated integral components of the mechanism 200, for automatically detecting the size of the media loaded within the loading tray, is now described in conjunction with FIG. 2A and FIG. 2B. When the media 113 is loaded, the guiding members 106A and 106B are moved manually, to align with any set of opposite edges of the loaded media 113. Being centrally aligned with the racks, the movement of the guiding members cause the racks to move correspondingly. If the racks 202A and 202B move towards each other, they cause the cam 206 and pinion 204 to rotate simultaneously, in counter-clockwise direction and, similarly, movement of the racks 202A and 202B away from each other, causes the cam 206 and the pinion 204 to rotate in the clockwise direction. As the cam 206 moves, the pin 212 engaging the slot 208 slides within the sensor 210. As is apparent, the counter-clockwise movement of the cam 206 causes the pin to slide towards the left within the sensor 210. Similarly, a clock-wise movement of the cam 206 pushes the pin 212 outward it slide towards the right within the sensor 210. Based on the extent of rotation of the cam 206, the pin 212 traverses a specific distance within the sensor 210. The sensor 210 thus generates a signal representing the size of the loaded media.

FIG. 3 clearly illustrates the pinion 204 and cam 206 as a consolidated body, in accordance with the present disclosure. As shown, the cam 206 is fixedly attached to, and in this embodiment lies coaxially with the pinion 204 in the sense that the cam 206 increases in radius evenly with each degree of rotation about the axis. Hence, as mentioned earlier, both the pinion 204 and the cam 206 rotate simultaneously, either clockwise, or counter-clockwise, between the first angular position and the second angular position, in response to the movement of the racks 202A and 202B. Specifically, since inward movement of the racks towards each other is restricted beyond a specific limit, due to dimensional constraints, the counter-clockwise movement of the cam 206 and the pinion 204 is effectively restricted beyond a specific angular position. Similarly, outward movement of the racks, away from each other, is restricted beyond a specific limit, and this restricts the extent of clockwise rotation of the cam 206 and the pinion 204 beyond a specific angular position.

Figure 4A:
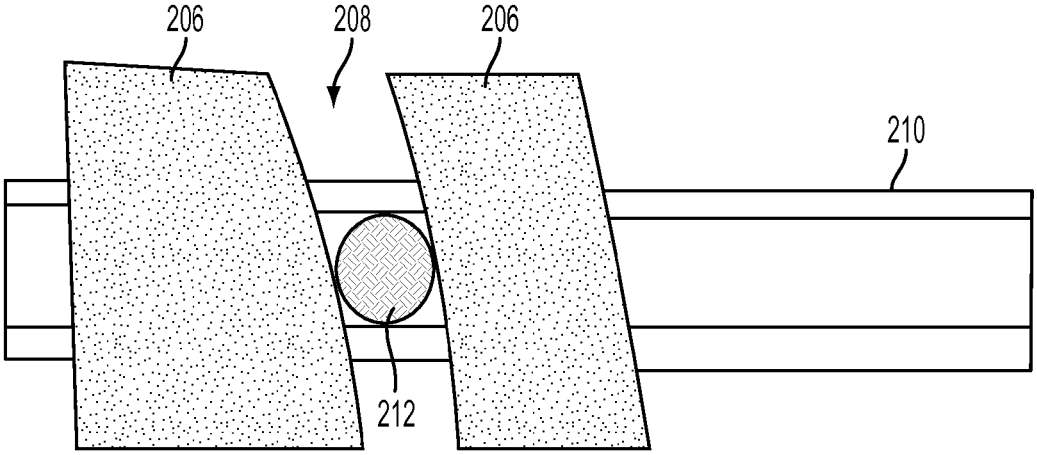
FIG. 4A is a top view of a sensor, being an integral component of the mechanism of the present disclosure.

FIG. 4A clearly illustrates the pin 212 engaging the cam slot 208 within the cam 206. The sensor 210 is configured to provide a signal corresponding to the size of the loaded media 113, based on the extent of linear movement of the pin 212. Those in the art will understand that any suitable sensor, such as, a linear potentiometer can be used, for this purpose. The range of the linear potentiometer may vary, depending upon factors, including space and cost constraints. Further, the sensor 210 is held in place by a suitable means, and is restricted from moving when the cam rotates and pulls or pushed the pin 212 positioned therein. The pin 212 positioned in the cam slot 208, is configured to slide from a 'first extreme linear position' to 'second extreme linear position'. The first extreme linear position of the pin 212 corresponds to the first extreme angular position of the cam 206, and, similarly, the second extreme linear position of the pin 212 corresponds to the second extreme angular position of the cam 206.

In another embodiment, the cam may have a spring attached to its outer surface. The spring is configured to slide the pin 212, in response to the rotation of the cam. Specifically, the spring slides the pin 212 towards the right, as the cam 206 rotates clockwise, and towards the left, as the cam 206 rotates counter-clockwise.

In one embodiment, each of the racks 202A and 202B traverses a maximum distance of approximately 120 mm, in either direction. Further, the pinion 204 and the cam 206 rotate in a range of 0-320 degrees between the extreme angular positions, in response to the movement of the racks 202A and 202B, respectively. The pin 212 slides within a range of about 0-30 (40 mm) mm within the sensor 210. Effectively, when the cam is at it's the first extreme angular position of the cam, the pin 212 is at the leftmost end of the sensor 210. Further, when the cam rotates till it reaches the other extreme angular position, it continuously pushes the pin 212 towards the right or left. Effectively, the pin 212 continuously slides towards the right, and traverses a distance of about 30 to 40 mm within the sensor 210.

To detect the size of the loaded media 113, the sensor 210, in one embodiment, is configured to generate a voltage signal in response to the extent of movement of the pin 212. Specifically, a continuously rising voltage signal is generated as the pin 212 pushed from the 'first extreme linear position' to the 'second extreme linear position' (i.e., towards the right direction), and similarly, a continuously falling voltage signal is generated when the pin 212 is pulled from the 'second extreme linear position' to the 'first extreme linear position' (i.e., towards the left direction within the sensor 210). Each voltage value generated between the 'first extreme linear position' and the 'second extreme linear position' is unique, and indicates the distance traversed by the guiding members 106A and 106B. This allows the mechanism to depict the size of the media 113 loaded within the imaging device.

In this embodiment, a processing unit is coupled to the sensor 210. The sensor 210 transmits the voltage signal to the processing unit. The processing unit converts the voltage values into a corresponding size of media 113 loaded in the media loading tray, and displays the media 113 size on a graphical user interface of the imaging device. The processor maybe configured to send the media size information at different times, such as, when the user inserts the media 113, when the guiding members 106A and 106B are adjusted to align with the edges of the media 113 or when the user opens or closes the Multi sheet tray assembly 100.

Figure 4B:
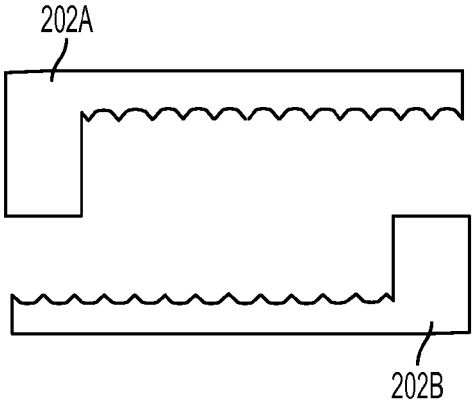
FIG. 4B illustrates the structure of the racks, being integral components of the mechanism of the present disclosure.

FIG. 4B illustrates the structure of the racks 202A and 202B. As mentioned before, the two racks 202A and 202B are elongate and restrict the rotation of the cam 206 between a first extreme angular position to a second extreme angular position.

Although the current invention has been described with respect to specific embodiments, those skilled in the art would recognize that other versions of the invention may also be possible.

What is claimed is:

1. A mechanism for detecting the size of a media loaded in an imaging device, the mechanism comprising:

a first and a second movable guiding member positioned within a media loading tray of the imaging device, the guiding members being configured to align with a first set of opposite edges of a loaded media;

a first and a second rack, operatively coupled to the guiding members, the racks being configured to move linearly, in opposite directions, in response to the movement of the guiding members;

a pinion positioned between the first and second racks and engaging with the first and the second racks, the pinion being rotatable in a clockwise or counter-clockwise directions, in response to the linear movement of the first and the second rack;

a cam attached to the pinion, and being configured to rotate along with the rotation of the pinion, the cam having at least one arcuate surface provided therein;

a pin engaging the arcuate surface of the cam; and a sensor associated with, and coupled to the pin, and being configured to output a signal based on a spatial position of the pin engaging the arcuate surface.

2. The mechanism of claim 1, wherein the pin is configured to linearly slide relative to the sensor.

3. The mechanism of claim 2, wherein the cam is configured to actuate sliding of the pin relative to the sensor, and the distance traversed by the sliding pin, is related to a degree of rotation of the cam.

4. The mechanism of claim 1, wherein the signal output by the sensor is associated with the dimensions of the media loaded within the imaging device.

5. The mechanism of claim 1, wherein the arcuate surface of the cam has a uniformly increasing radial width relative to a rotational axis of the cam, the radial width increasing with each degree of rotation of the cam about the rotational axis.

6. The mechanism of claim 1, wherein each of the two racks is movable between a first extreme position and a second extreme position.

7. The mechanism of claim 1, wherein the cam is movable between a first extreme angular position and a second extreme angular position.

8. The mechanism of claim 7, wherein each of the two extreme angular positions of cam's rotation corresponds to a specific extreme position of the sliding pin.

9. The mechanism of claim 7, wherein, the first extreme positions of the two racks correspond to the first extreme angular position of the cam, and the second extreme positions of the two racks correspond to the second extreme angular position of the cam.

10. The mechanism of claim 9, wherein the sliding pin is linearly movable between two extreme positions within the sensor, in response to the movement of the cam between the first extreme angular position and the second extreme angular position.

* * * * *